United States Patent [19]

Eckert

[11] 4,418,789

[45] Dec. 6, 1983

[54] MUFFLER FOR A TEXTILE INTERLACING JET

[75] Inventor: Wayne L. Eckert, Greensboro, N.C.

[73] Assignee: Burlington Industries, Inc., Greensboro, N.C.

[21] Appl. No.: 356,143

[22] Filed: Mar. 8, 1982

[51] Int. Cl.[3] ..... F01N 1/08

[52] U.S. Cl. ..... 181/255; 181/282; 226/97; 28/271

[58] Field of Search ..... 181/200, 211, 212, 230, 181/232, 250, 264, 255, 272, 282, 296; 226/7, 95, 97; 28/271

[56] References Cited

U.S. PATENT DOCUMENTS

| | | | |
|---|---|---|---|
| 3,127,729 | 4/1964 | Head | 28/271 |
| 3,713,509 | 1/1973 | Carroll | 181/200 |
| 3,911,655 | 10/1975 | London, Jr. et al. | 28/271 X |
| 4,030,651 | 6/1977 | Weiss et al. | 181/264 X |
| 4,043,008 | 8/1977 | Weiss et al. | 181/200 X |
| 4,110,876 | 9/1978 | Weiss et al. | 28/271 |
| 4,141,121 | 2/1979 | Trifunovic | 28/271 |
| 4,141,122 | 2/1979 | Trifunovic | 28/271 |

*Primary Examiner*—Benjamin R. Fuller

*Attorney, Agent, or Firm*—Cushman, Darby & Cushman

[57] ABSTRACT

A textile interlacing jet is used to muffle noise in the frequency range of 3 kHz to 20 kHz by providing abrupt cross-sectional area changes. The jet includes a main body with a yarn inlet and a yarn outlet at opposite ends. A first reactive muffler is disposed in association with the yarn inlet and includes an expansion chamber and a restricted inlet to the expansion chamber, the ratio of the cross-sectional area of the expansion chamber to that of the restricted inlet being at least about 9:1, and preferably at least about 25:1. A second reactive muffler is disposed in association with the yarn outlet, and has similar abrupt cross-sectional area changes. A plurality of expansion chambers and restricted outlets may be provided in the second reactive muffler.

10 Claims, 3 Drawing Figures

MUFFLER FOR A TEXTILE INTERLACING JET

BACKGROUND AND SUMMARY OF THE INVENTION

Textile interlacing jets have been found to be a source of a substantial amount of noise. They can result in an undesirable work environment if a number of jets are provided in the same work area. Practical problems in muffling such noise have been great due to the fact that the interlacing jet operates at fluid velocities of about 0.3–0.6 times the speed of sound, and the noise is typically very high frequency (on the order of 3 kHz to 20 kHz). The mufflers must be able to achieve substantial noise reduction (e.g., on the order of about 15 to 20 dB(A)) while not adversely affecting the yarn being processed.

Typical prior art suggestions for mufflers for interlacing jets utilize dissipative mufflers, which include sound absorbing material that converts incident sound into heat. Typical of such a muffling apparatus is that disclosed in U.S. Pat. No. 3,713,509. While dissipative mufflers can perform their sound-reducing function, the sound absorbing material associated therewith can become contaminated with size and lint, thereby significantly reducing its performance and requiring a substantial amount of maintenance. Additionally, proposed dissipative muffler designs require relatively bulky structures, which can interfere with normal operator procedures.

According to the present invention a muffler for an interlacing jet is provided that requires very little maintenance, does not substantially increase the size of the interlacing jet, and yet functions so as to produce substantial noise reductions, on the order of 15 to 20 dB(A). This is accomplished according to the present invention by utilizing reactive muffler means in association with both the yarn inlet and yarn outlet of the jet, each reactive muffler means including a large expansion chamber and a restricted inlet or outlet. The change in cross-sectional area from the expansion chamber to the restricted inlet or outlet is abrupt; i.e., the ratio of the areas is at least about 9 to 1, and preferably at least about 25 to 1. The invention is effective despite the fact that the fluid velocity and noise frequency ranges associated with an interlacing jet are substantially different from these ranges in environments where reactive mufflers are conventionally employed. Most conventional applications of reactive mufflers are restricted to fluid velocities of less than about 0.2 times the speed of sound, and typically in the 50 Hz to 1 kHz frequency range.

By utilizing the muffled textile interlacing jet according to the present invention, a method of muffling sound from the jet is provided, the jet operating with fluid velocities of about 0.3–0.6 times the speed of sound and producing noise in the frequency range of about 3 kHz to 20 kHz. A first reactive muffler is placed in operative association with the jet yarn inlet, and a second reactive muffler is placed in operative association with the jet yarn outlet. The mufflers are effective to achieve a reduction in sound in the 3 kHz to 20 kHz range of about 15 to 20 dB(A), or sometimes even more. The mufflers are maintained in place as the yarn passes therethrough, and through the interlacing jet for interlacing, the mufflers not adversely affecting the properties of the yarn.

It is the primary object of the present invention to provide for the reactive muffling of a textile interlacing jet. This andother objects of the present invention will become clear from an inspection of the detailed description of the invention, and from the appended claims.

DETAILED DESCRIPTION OF THE DRAWINGS

Figure 1:
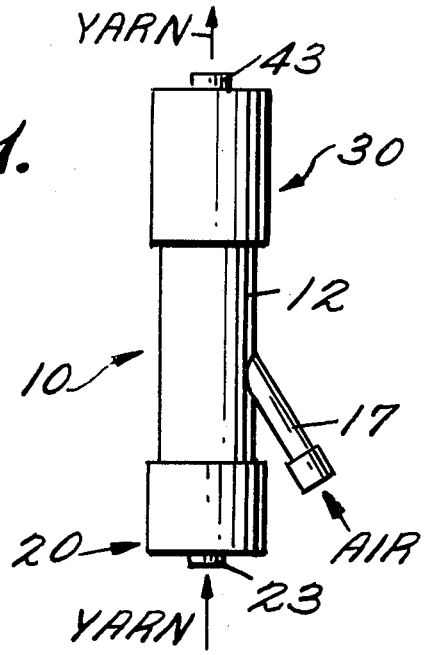
FIG. 1 is a side elevational view of an exemplary textile interlacing jet according to the present invention.

An exemplary textile interlacing jet according to the present invention is shown generally by reference numeral 10 in FIG. 1. The jet includes a main interlacing body portion 12 which includes a yarn inlet 13 (see FIG. 2) at a first end thereof, and a yarn outlet 14 (see FIG. 3) at a second end thereof, the yarn inlet and outlet being connected by a continuous passageway 15 of varying cross-sectional areas. An air inlet 17 is provided between the yarn inlet 13 and outlet 14. The interlacing jet can assume a wide variety of conventional configurations, a preferred configuration being that disclosed in U.S. Pat. No. 3,911,655, the disclosure of which is hereby incorporated by reference herein.

A first reactive muffler means, 20, is disposed in operative association with the body portion 12 first end (see FIG. 2 in particular) and includes an expansion chamber 21 having a substantially larger cross-sectional area than the jet yarn inlet 13. The first reactive muffler means 20 further comprises a restricted inlet 22 to the expansion chamber 21. The inlet 22 is large enough for free passage of the yarn therethrough, but provides an abrupt cross-sectional area change with the expansion chamber 21, the ratio of the cross-sectional area of the expansion chamber 21 to that of the restricted inlet 22 being at least about 9:1, and preferably being at least about 25:1. The restricted inlet 22 is preferably provided by a ceramic sleeve 23.

Figure 2:
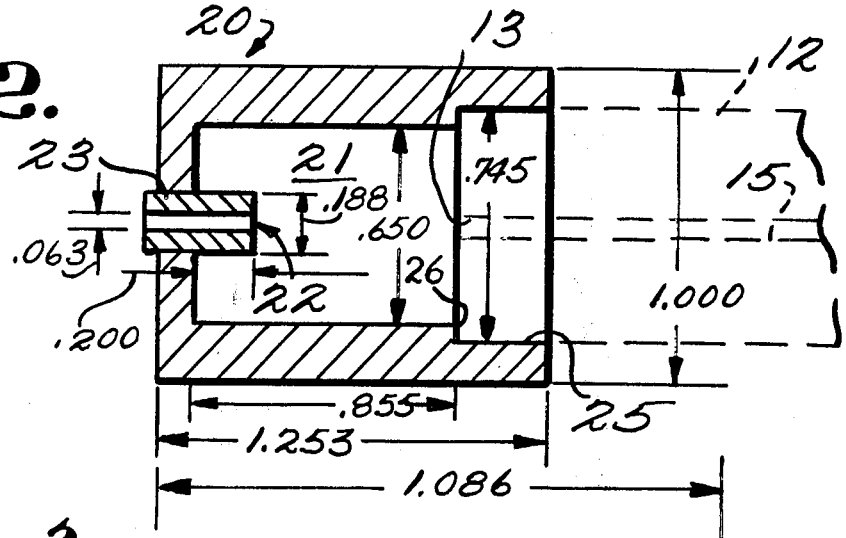
FIG. 2 is a longitudinal cross-sectional view of an exemplary inlet reactive muffler of the apparatus of FIG. 1, with the interlacing jet body shown in dotted line.

The material of which the reactive muffler means 20 is formed is not crucial, typical materials being brass and hard plastic. Preferably it is press-fit onto the first end of the jet body 12, as illustrated in FIG. 2, an annular cutout 25 in the end of the first muffler 20 opposite the sleeve 23 having cross-sectional dimensions substantially the same as the first end of the jet 12. A shoulder 26 arrests movement of the jet 12 toward the expansion chamber 21 so that an appropriate spacing is provided between the sleeve 23 and the yarn inlet 13. The sleeve 23 is pressed into the closed end of muffler 20 so that it extends into its interior. Although it may also extent outside, it is generally preferred that it be substantially flush with the outer wall. Typically the passageway 15, the expansion chamber 21, and the restricted inlet 22 are circular in cross-section.

While FIG. 2 illustrates exemplary dimensions for the first reactive muffler means 20, the dimensions may vary depending upon the amount of sound reduction desired for the particular work environment, and the particular design of the jet 12. By utilizing the muffler means 20 illustrated in FIG. 2 (in conjunction with the second reactive muffler means to be hereafter described), a noise reduction of about 15 to 20 dB(A) can be achieved when the textile interlacing jet 12 is of the design illustrated in U.S. Pat. No. 3,911,655, operates with fluid velocities of about 0.3–0.6 times the speed of sound, and produces noise having a frequency of about 3 kHz to 20 kHz.

Figure 3:
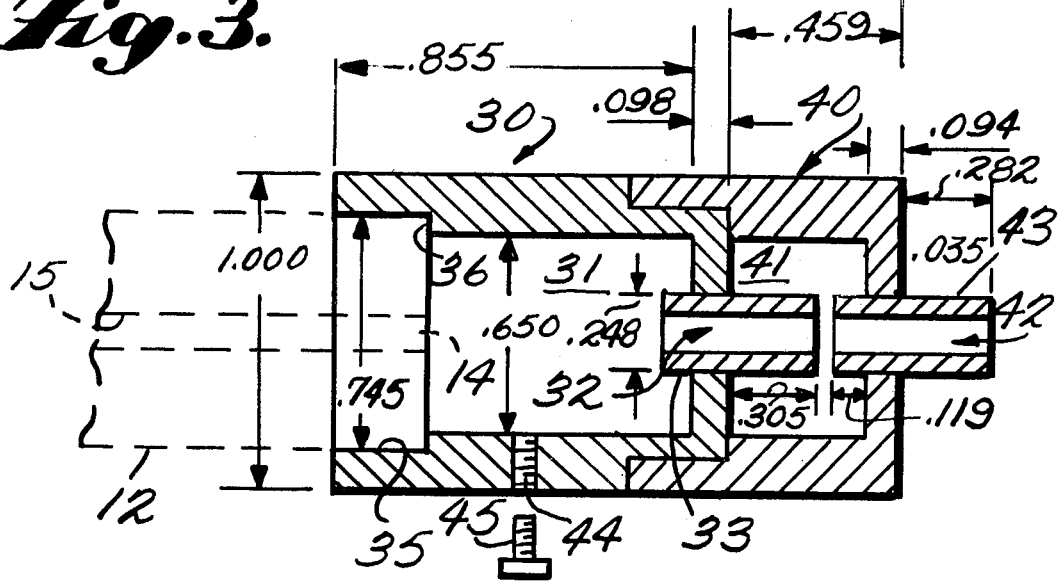
FIG. 3 is a longitudinal cross-sectional view of an exemplary outlet reactive muffler utilized in the apparatus of FIG. 1, with the interlacing jet body shown in dotted line.

The apparatus 10 according to the invention further comprises a second reactive muffler means 30, which is illustrated most clearly in the left-hand side of FIG. 3. The second reactive muffler means 30 also includes an expansion chamber 31 having an abrupt cross-sectional area change with respect to a restricted outlet 32 therefrom. The ratio of the cross-sectional area of the expansion chamber to that of outlet 32 is at least about 9:1, and preferably at least about 25:1. The restricted outlet 32 preferably is provided by a ceramic sleeve 33, and is large enough that the yarn may pass freely therethrough. Outlet 32 is preferably larger than inlet 22, as shown in FIGS. 2 and 3. The second muffler 30 is preferably mounted onto the jet body portion 12 in the same manner as the first muffler 20, i.e., a press-fit is provided by an annular cutout portion 35, with a shoulder 36 limiting penetration of the body 12 into the expansion chamber 31.

Since the majority of sound produced by the jet has a tendency to pass toward the outlet, preferably the second muffler means 30 has attached thereto at least one more muffler section 40, having a second expansion chamber 41. The second expansion chamber 41 also leads to a restricted outlet 42, which preferably is defined by a ceramic sleeve 43, substantially the same size as the sleeve 33 of first restricted outlet 32. Although other means for attaching muffler section 40 to muffler 30 will be apparent to one skilled in the art, it may most readily be done by press-fitting, as shown in FIG. 3. The second muffler 30 and muffler section(s) 40 may be made of the same materials as the first muffler 20, and have the same cross-sectional configuration (e.g., circular).

The dimensions illustrated in FIG. 3 are exemplary, and may be varied depending upon the amount of sound reduction to be achieved, the type of interlacing jet, etc. The dimensions illustrated for the second muffler 30 in FIG. 3 are effective to provide—when the second muffler 30 and muffler section 40 are used in conjunction with the first muffler 20—a noise reduction of about 15 to 20 dB(A) for an interlacing jet of the design shown in U.S. Pat. No. 3,911,655, operating with fluid velocities of about 0.3–0.6 times the speed of sound and producing noise in the range of 3 kHz to 20 kHz.

For maximum noise reduction, ceramic sleeves 33 and 43 preferably should project on both sides from the walls in which they are set, it being particularly desirable that the outermost sleeve extend into the outer air. This means that if muffler section 40 is not employed, sleeve 33 should project into the outer air, and when muffler 40 is employed, sleeve 43 should so project.

The small gap shown in FIG. 3 between sleeves 33 and 43 is also important for achieving maximum noise reduction. Its exact magnitude will vary slightly within a few thousandths of an inch, depending upon the particular yarn and air pressure employed. The 0.035-inch width shown in FIG. 3 is an average taken from "tuning" a muffler employed with a jet operated with 15, 30, and 45 psig of air pressure. To permit such tuning for achieving the best noise reduction, sleeves 33 and 43 should be press-fit rather than cemented into the walls of the muffler, thereby making it possible to slide them to the right or left for optimum adjustment of the gap between them.

It is sometimes found to be difficult to make the initial yarn thread-up through the combination of the inlet muffler, interlacing jet, and exit muffler, seemingly because of undesirable back pressure. This is overcome by drilling a small hole 44, about 0.1-inch in diameter, for example, through the wall of chamber 31. With this hole open, thread-up proceeds easily, after which hole 44 is closed for the remainder of the interlacing process. Closing is most easily accomplished by sliding an elastic sleeve (not shown) across the hole, or by screwing a small plug 45 into the hole.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A textile interlacing jet comprising:

a main interlacing body portion including a yarn inlet at a first end thereof, a yarn outlet at a second end thereof, and an air inlet intermediate said yarn inlet and outlet, said yarn inlet and outlet being connected by a continuous passageway;

first reactive muffler means disposed in operative association with said body portion first end and including an expansion chamber having a substantially larger cross-sectional area than said yarn inlet, and further including a restricted inlet to said expansion chamber, said restricted inlet being large enough for free passage of yarn therethrough, but providing an abrupt cross-sectional area change with said expansion chamber, the ratio of the cross-sectional area of said expansion chamber to that of said restricted inlet being at least about 9:1; and second reactive muffler means disposed in operative association with said body portion second end and including an expansion chamber having a substantially larger cross-sectional area than said yarn outlet, and further including a restricted outlet therefrom, said restricted outlet being large enough for free passage of yarn therethrough, but providing an abrupt cross-sectional area change with said expansion chamber, the ratio of the cross-sectional area of said expansion chamber to that of said restricted outlet being at least about 9:1.

2. A jet as recited in claim 1 wherein said second reactive muffler means further comprises a second expansion chamber disposed in operative engagement with the restricted outlet from said expansion chamber, said second expansion chamber having a second restricted outlet large enough for free passage of yarn therethrough, but providing an abrupt cross-sectional area change with said second expansion chamber, the ratio of the cross-sectional area of said second expansion chamber of that of said second restricted outlet being at least about 9:1.

3. A jet as recited in claim 2 wherein the ratio of the cross-sectional area of said expansion chamber to that of said restricted inlet of said first reactive muffler means is at least about 25:1, and wherein the ratio of the cross-sectional area of said expansion chamber to that of said restricted outlet of said second reactive muffler means is at least about 25:1.

4. A jet as recited in claim 1 wherein said ratio of the cross-sectional area of said expansion chamber to that of said restricted inlet of said first reactive muffler means, and of said expansion chamber and said restricted outlet of said second reactive muffler means, is each at least about 25:1.

5. A jet as recited in claims 1 or 4 wherein said restricted inlet and said restricted outlet are provided by ceramic sleeves.

6. A jet as recited in claim 1 wherein said main body portion, first reactive muffler means, and second reactive muffler are all circular in cross-section, and wherein each of said first and second reactive muffler means in disposed in operative association with said interlacing body portion by an annular cutout formed in said muffler means receiving said body portion, and a shoulder of said muffler means restricting penetration of said body portion into each of said expansion chambers.

7. A jet as recited in claims 1 or 2 wherein each of said expansion chamber is circular in cross-section and has a diameter of about 0.65 inches.

8. A jet as recited in claim 1 wherein said restricted inlet and said restricted outlet each comprises an elongated sleeve which extends a substantial distance from a dividing wall into its associated expansion chamber, and wherein said restricted outlet sleeve extends a substantial distance from the dividing wall exteriorly of its associated expansion chamber.

9. A method of muffling sound from a textile interlacing jet having a yarn inlet first end and a yarn outlet second end, with an air inlet therebetween, the jet operating with fluid velocities of about 0.3–0.6 times the speed of sound and producing noise in the range of about 3 kHz to 20 kHz, comprising the steps of:

placing a first reactive muffler in operative association with the jet yarn inlet;

placing a second reactive muffler in operative association with the jet yarn outlet;

the mufflers effective to achieve a reduction of sound in the 3 kHz to 20 kHz range of about 15 to 20 dB(A); and maintaning the mufflers in place as yarn is passed therethrough, and through the interlacing jet, for interlacing.

10. A method as recited in claim 9 wherein said first reactive muffler placing step is practiced by placing a respective muffler having a single expansion chamber and restricted inlet over said interlacing yarn inlet first end; and wherein said second reactive muffler placing step is accomplished by placing a second reactive muffler having a pair of expansion chambers and restricted outlets over said yarn outlet second end.

* * * * *